United States Patent [19]

Chou et al.

[11] Patent Number: 4,962,790

[45] Date of Patent: Oct. 16, 1990

[54] FAUCET HAVING PROXIMITY ACTUATION CONTROL AND HAND CONTROL THAT CAN BE INTERCHANGEABLE

[76] Inventors: Ching-Liang Chou, 49, Alley 37, Chung Hsing Road; Kai-lin Hsieh, 157, Nan Lei Road, both of Ho Mei Town, Chunghua County, Taiwan

[21] Appl. No.: 391,297

[22] Filed: Aug. 9, 1989

[51] Int. Cl.[5] ..... F16K 31/02; F16K 11/056

[52] U.S. Cl. ..... 137/599; 137/607; 251/129.04

[58] Field of Search ..... 137/599, 625.41, 607; 251/129.04

[56] References Cited

U.S. PATENT DOCUMENTS

| | | | |
|---|---|---|---|
| 3,390,701 | 7/1968 | Moen | 137/625.41 |
| 4,156,438 | 5/1979 | Kiesow | 137/625.41 |
| 4,562,864 | 1/1986 | Yang | 137/625.41 |
| 4,681,141 | 7/1987 | Wang | 137/607 |
| 4,709,728 | 12/1987 | Ying-Chung | 137/599 X |

*Primary Examiner*—Stephen M. Hepperle

[57] ABSTRACT

The present invention provides an improved faucet which has two holes (115), (116) formed on the bottom of a hemispherical valve seat (113) on the same plane, two channels (117), (118) formed on another plane and these two planes cross each other; six holes on a ball valve (14) are separated by two groups, one group of holes (142), (143), (144) respectively match the channel (117) and holes (115), (116); when the ball valve (14) is turned, another group of holes (145), (146), (147) respectively match the channel (118) and holes (115), (116); a holding groove (148) for a holding protrusion (114) to pass through and hold the ball valve (14) in position; an H-shaped guide groove (152) formed on a valve stem guide (15) for a valve stem (141) to pass through and connect with a handle (24); a bi-directional feed pipe with one end connects with a valve outlet hole (124) which open or close is controlled by a solenoid valve (31), with the other end connects with the channel (118); a pipe juncture (134*a*) formed on the feed pipe (134) is connected with an outlet pipe (131); a hot water inlet pipe (133) and a cold water inlet pipe (132) respectively connect with the holes (115), (116); the solenoid valve (31) of a proximity acutation assembly (30) connects with a valve seat recess (122) and an inner rim of valve holder (123); when the handle (24) is pulled forward down, the improved faucet is controlled by the proximity acutation assembly (30); if power failure occurs, pull the handle (24) backward up; the improved faucet will become hand controlled.

3 Claims, 8 Drawing Sheets

6—6

FAUCET HAVING PROXIMITY ACTUATION CONTROL AND HAND CONTROL THAT CAN BE INTERCHANGEABLE

BACKGROUND OF THE PRESENT INVENTION

The present invention relates to a faucet; more particularly, it relates to a faucet that has interchangeable proximity actuation control and hand control for hot/-cold water.

Accordingly, hot water and cold water have their own faucet and pipe. The water temperature can only be adjusted in a sink, basin or tub. Thus we got warm water. Thereafter, the faucet heads had been changed to form only one outlet A2, cold water handle A3 and hot water handle A4 are formed on a main shell A1(see FIG. 1). By this way, water temperature can be adjusted by cold water handle A3 and hot water handle A4 when the water is out from the outlet A2. Somehow the handles were improved to become one handle bar B1 constructed as shown in FIG. 2. By turning handle bar B1 clockwise or counterclockwise to control the flow and temperature of the water. Moreover, the improvement of the faucet kept going on, the automation of water control had been proffered for people's convenience. The control means C1 consists on a solenoid valve C11, a control unit C12 and an infra-red emitter/-sensor C13. As shown in FIG. 3, main pipe C3 was connected with faucet seat C2. Hot water conduit C32 and cold water conduit C31 were separately connected with and on the lower side of the main pipe C3. Hot water controlling handle C32*a* and cold water controlling handle C31*a* were respectively set on hot water and cold water conduits C32 and C31. Though the control means C1 did work, the flow and the temperature are still controlled by the hot water and the cold water controlling handles C32*a* and C31*a*. Moreover, when blackout occurs, this kind of faucet has no way to work and that causes people a lot of inconvenience.

OBJECT OF THE PRESENT INVENTION

The main object of the present invention is to provide an improved faucet that is controlled by electronic means; somehow when power failure occurs, it can be changed to hand control.

SUMMARY OF THE PRESENT INVENTION

The present invention provides a faucet that has interchangeable proximity actuation control and hand control for hot/cold water which comprises: a main assembly, a faucet shell assembly and a proximity actuation assembly. The main assembly has five major parts which are: a valve seat body with a valve seat rim, a receiving notch, a hemispherical valve seat, a holding protrusions, two water inlet holes and two water outlet channels; a solenoid valve holder with a lower surface, a valve seat recess, an inner rim, a valve outlet hole, a valve inlet annulus, a valve seat protrusion and a solenoid valve inlet; a water conduit assembly with an outlet pipe, a faucet head, two water inlet pipes and connection means, a bi-directional feed pipe and a pipe juncture; a ball valve with a valve stem, a front and a rear water outlet holes, four water inlet holes and a holding groove; a valve stem guide with an upper face, an H-shaped guide groove, a concave lower face and a locking protrusion. The faucet shell assembly has four primary parts which are: a main faucet shell with a faucet neck, a faucet throat and a handle socket seat; a faucet throat cover with a faucet opening and a sensor slot; a handle socket with a receiving hole; a handle; and a proximity actuation assembly with a solenoid valve, a control unit and an infra-red emitter/sensor.

BRIEF DESCRIPTION OF THE PRESENT INVENTION

DESCRIPTION OF THE PREFERRED EMBODIMENT OF THE PRESENT INVENTION

Figure 1:
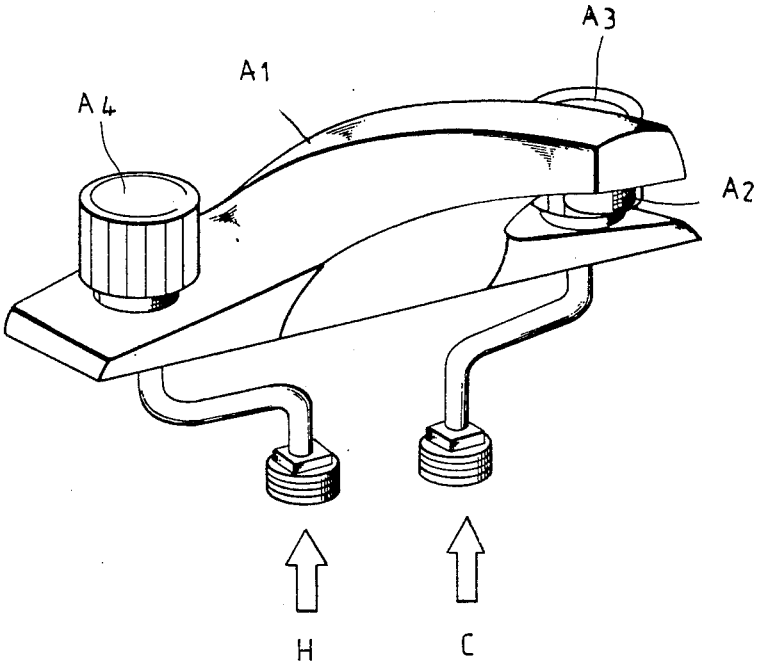
PRIOR ART FIG. 1
FIG. 1 is a perspective view of a conventional hand-control faucet.
Figure 2:
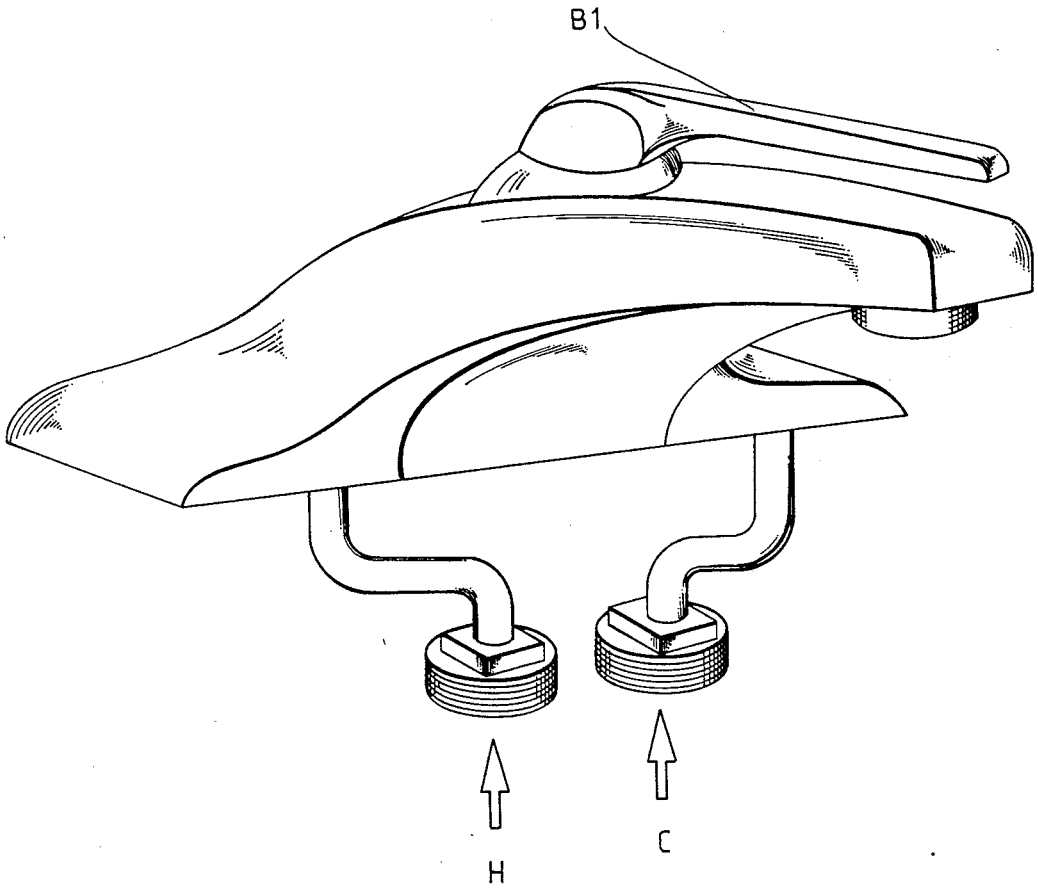
PRIOR ART F I G. 2
FIG. 2 is a perspective view of another conventional hand control faucet.
Figure 3:
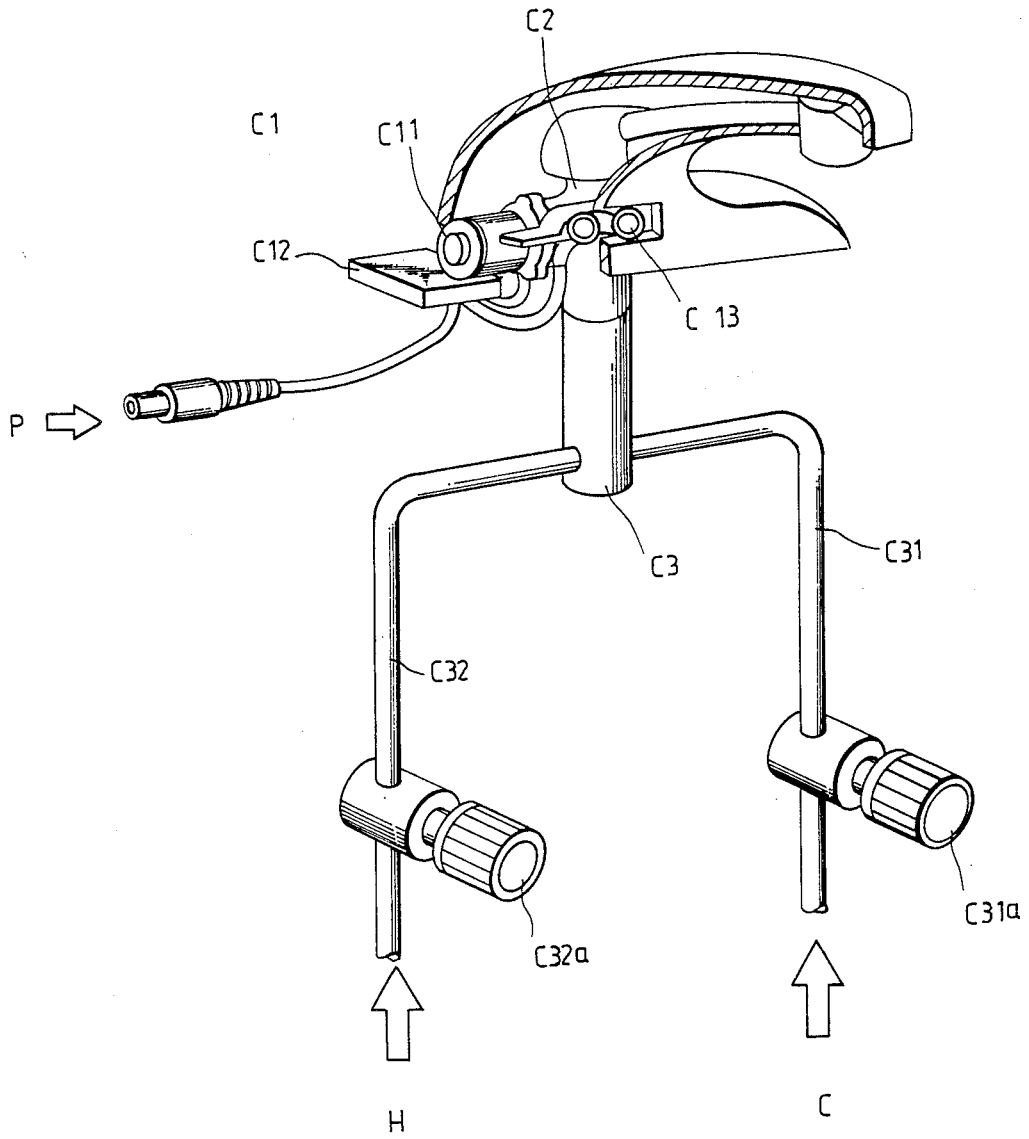
PRIOR ART F I G. 3
FIG. 3 is a perspective view of a conventional infra-red control faucet.
Figure 4:
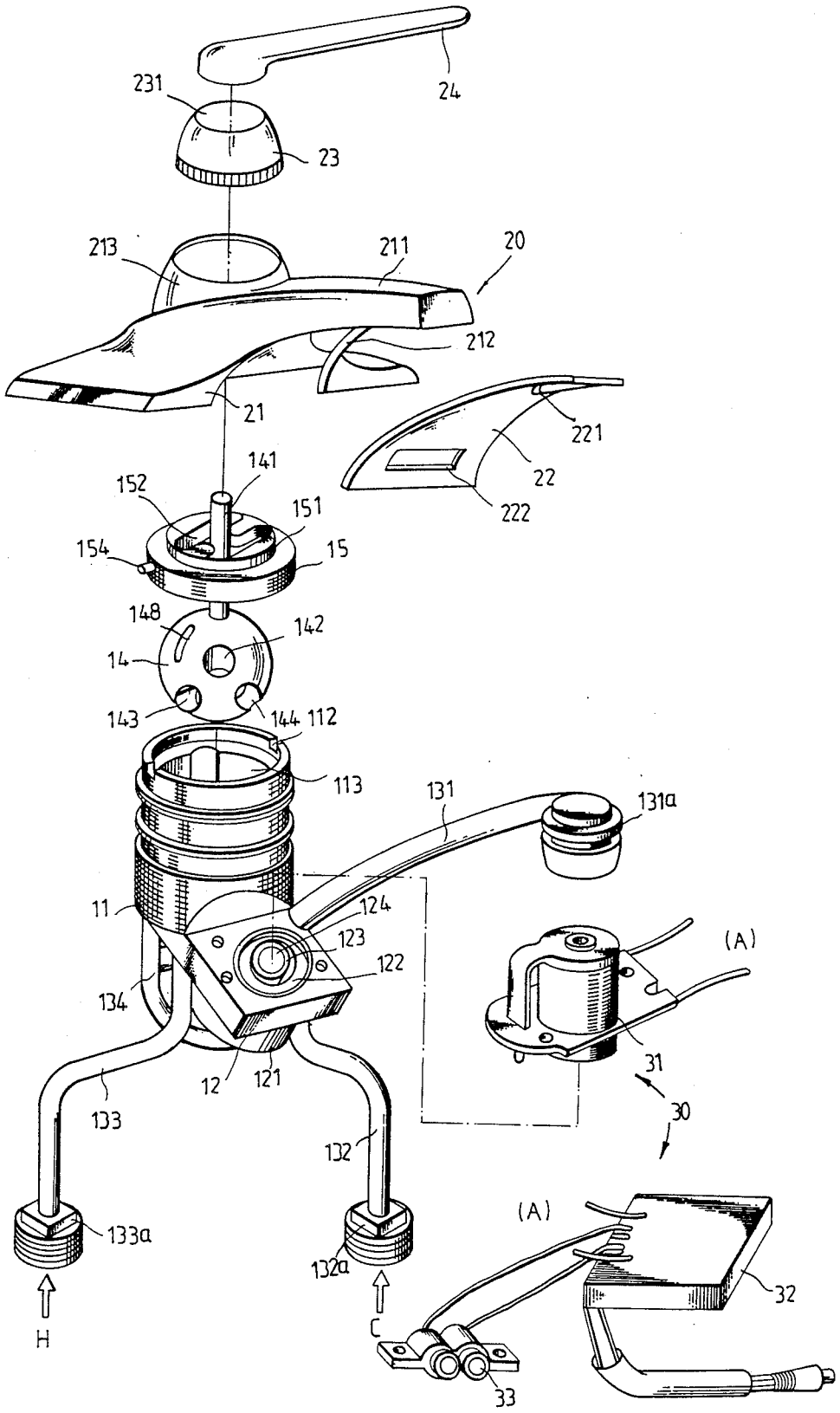
FIG. 4 is an exploded view of the preferred embodiment of the present invention.
Figure 5:
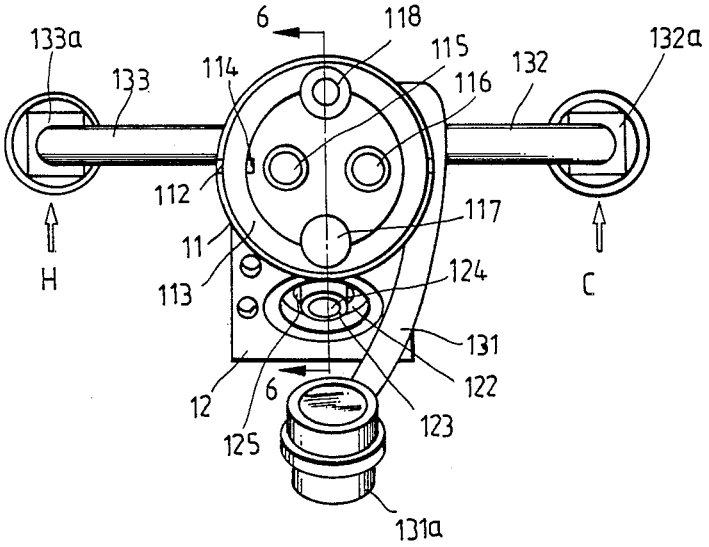
FIG. 5 is a top view of lower half of the preferred embodiment of the present invention.
Figure 6:
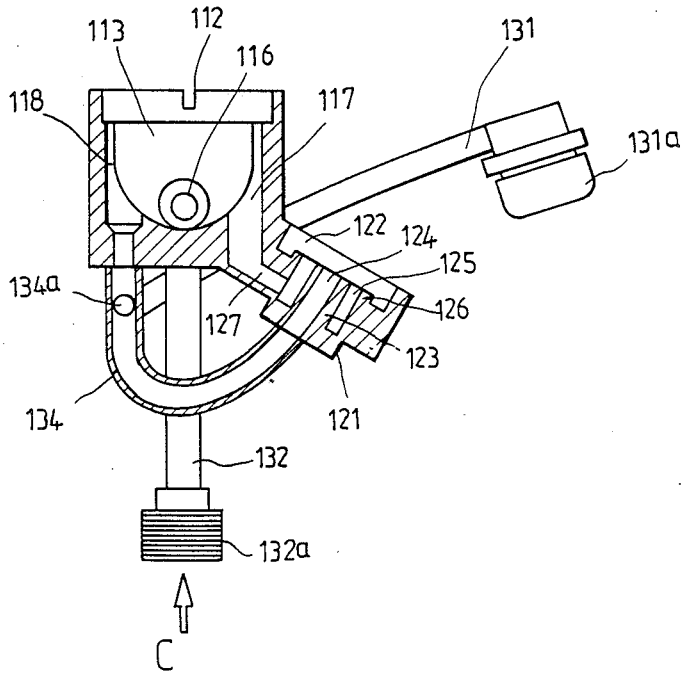
FIG. 6 is a side cross sectional view of lower half of the preferred embodiment of the present invention.
Figure 7:
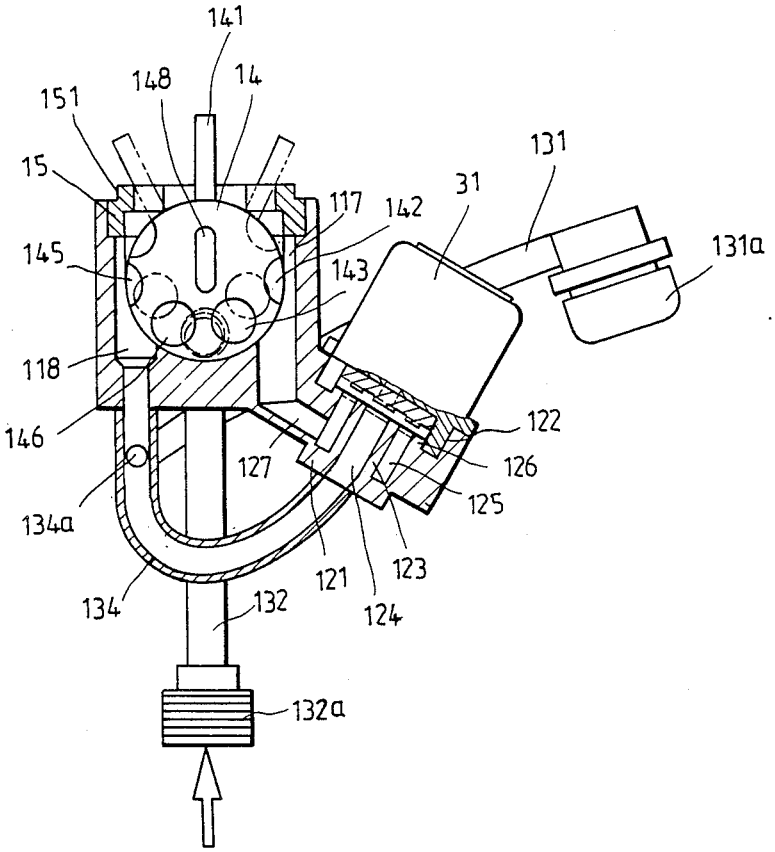
FIG. 7 is a side cross sectional view of lower half with ball valve assembly of the preferred embodiment of the present invention.
Figure 8:
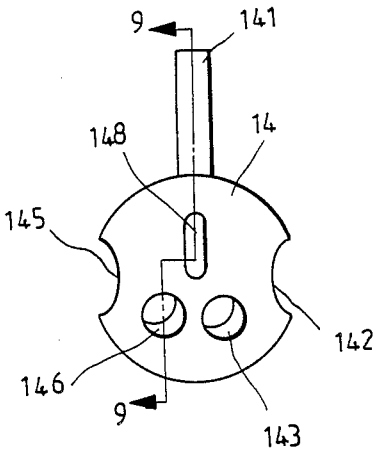
FIG. 8 is a side view of ball valve of the preferred embodiment of the present invention.
Figure 9:
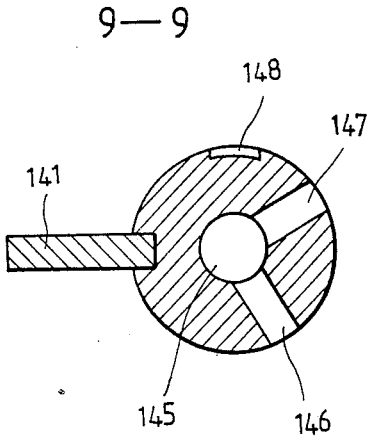
FIG. 9 is a side cross sectional view of ball valve of the preferred embodiment of the present invention.
Figure 11:
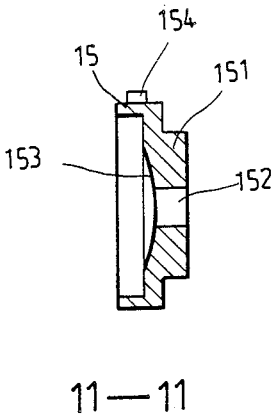
FIG. 11 is a side cross-sectional view of valve stem guide of the preferred embodiment of the present invention.
Figure 10:
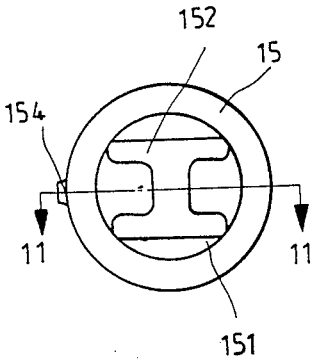
FIG. 10 is a top view of valve stem guide of the preferred embodiment of the present invention.
Figure 12:
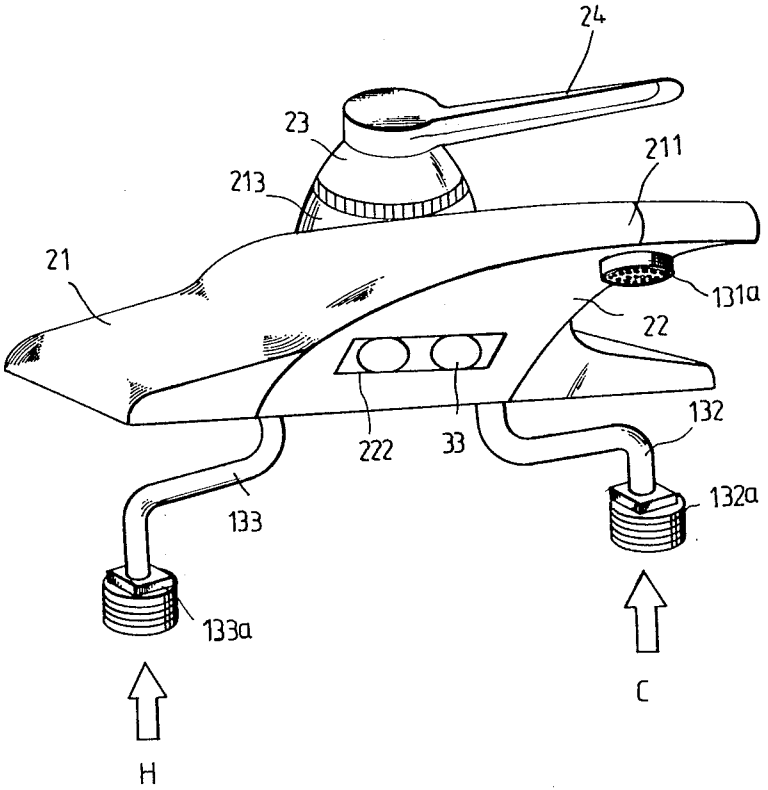
FIG. 12 is an assembled view of the preferred embodiment of the present invention.

Referring to FIG. 4, the structure of a faucet that has interchangeable proximity actuation control and hand control for hot/cold water is described hereunder: a main assembly 10 which comprise a valve seat body 11, a valve seat rim 111 is formed on the inner surface and near the top edge of the valve seat body 11, a pair of receiving notches 112 are formed diametrically opposed on the upper edge of valve seat body 11, a hemispherical valve seat 113 is formed on the lower side of valve seat rim 111. Referring to FIG. 5 and 6, a holding protrusion 114 is formed under and near valve seat rim 111, on the inner surface of valve seat body 11, a hot water inlet hole 115, a cold water inlet hole 116, are formed respectively on the left and right sides of the bottom of the hemispherical valve seat 113; a rear water outlet channel 118 and a front water outlet channel 117 are formed respectively on the upper side and the lower side of the bottom of the hemispherical valve seat 113. As shown in FIG. 4, a cold water inlet pipe 132 and a hot water inlet pipe 133 are connected respectively with the cold water inlet hole 116 and the hot water inlet hole 115; hot water and cold water pass through hot water inlet pipe connection means 133*a* and cold water inlet pipe connection means 132*a* and flow in hot water inlet pipe 133 and cold water inlet pipe 132. A solenoid valve holder 12 is formed under the bottom of the valve seat body 11, and a lower surface 121 is formed under the bottom of the solenoid valve holder 12. A valve seat recess 122 is formed on the solenoid valve holder 12. A valve inlet annulus 125 is formed under the valve seat recess 122, and a valve seat protrusion 126 is formed outside around the valve inlet annulus 125 (See FIG. 5 and 6). An inner rim of valve holder 123 is formed on the middle of the valve inlet annulus 125. A valve outlet hole 124 is formed on the inner rim of valve holder 123. A bi-directional feed pipe 134 connects the valve outlet hole 124 with one end and the rear water outlet channel 118 being, formed on the upper side of the bottom of the hemispherical valve seat 113 (see FIG. 5) with the other end. A pipe juncture 134*a* is formed on the concave spherical surface of the bi-directional feed pipe 134 (see FIG. 6,7). With the pipe juncture 134*a*, an outlet pipe 131 with a faucet head 131*a* is connected by the bi-directional feed pipe 134. A solenoid valve inlet 127 is formed on the periphery of the valve seat recess 122 and connected with the front water outlet channel 117 which is formed on the lower side of the bottom of the hemispherical valve seat 113 (see FIG. 6,7). Referring to FIG. 8 and 9, a ball valve 14 has a valve stem 141 extending upwardly from its upper periphery, a holding groove 148 axially extending downwardly from the valve stem 141 in FIG. 8 and formed on the upper hemisphere of the ball valve 14. The holding protrusion 114, as shown in FIG. 5, lies on the plane that is perpendicular to the 6—6 plane; when the ball valve 14 is placed into the hemispherical valve seat 113 of the valve seat body 11, the holding protrusion 114 will pass through the holding groove 148. Referring to FIG. 4, 7–9, a front water outlet hole 142 and a rear water outlet hole 145 are collinear. A front hot water inlet hole 143 and a front cold water inlet hole 144 form below and on the either side of the front water outlet hole 142, so do the rear hot water inlet hole 146 and cold water inlet hole 147 to the rear water outlet hole 145. The front water outlet hole 142, hot water inlet hole 143 and cold water inlet hole 144 could be turned to respectively match the front water outlet channel 117, hot water inlet hole 115 and cold water inlet hole 116 which are on the bottom of the hemispherical valve seat 113. When the ball valve 14 is turned, the rear water outlet hole 145 will match the rear water outlet channel 118, the rear hot water inlet hole 146 and the rear cold water inlet hole 147 will respectively match the hot water inlet hole 115 and the cold water inlet hole 116. Referring to FIG. 4, 10 and 11, a valve stem guide 15 has a locking protrusion 154 extending form from its periphery, a concave lower face 153 being corresponding to the spherical surface of the ball valve 14, an upper face 151 thereon an H-shaped guide groove 152 being provided; and therefore, the valve stem 141 will be allowed to pass through and easily move around in the H-shaped guide groove 152. The valve stem guide 15 rests on the valve seat rim 111 of the valve seat body 11 to be positioned by placing its locking protrusion 154 being in any one of the receiving notches 112. Referring to FIG. 4 and 7, a proximity actuation assembly 30 has a solenoid valve 31, a control unit 32 and an infra-red emitter/sensor 33 thereof; the solenoid valve 31, being connected with the control unit 32 and the infra-red emitter/sensor 33 is fastened to the solenoid valve holder 12 by connecting means, By means of the control unit 32 and the infra-red emitter/-sensor 33, the solenoid valve 31 will control the water to be blocked or to pass through the valve outlet hole 124 and the solenoid valve inlet 127. As shown in FIG. 4, a faucet shell assembly 20 comprises four parts: a main faucet shell 21, a faucet throat cover 22, a handle socket 23 and a handle 24. The main faucet shell 21, including a faucet neck 211, extending outwardly and somewhat upwardly from thereon, the extending of the faucet neck 211 thereunder, shaping a faucet throat 212, extending concavely and downwardly to the lower edge of the faucet shell 21, and following its extending the width of the faucet throat 212 slightly expanding, from the rear portion of the faucet neck 211 extending upwardly and gradually inwards to form a handle socket seat 213, having an opening on its upper edge, enabling to prevent the valve stem guide 15 and the ball valve 14 from projecting therethrough, except the valve stem 141. The faucet throat cover 22 is, corresponding to the shape of the faucet throat 212, provided for attaching to the faucet throat 212 and covering the assembly of the main assembly 10 and the proximity acutation assembly 30 inside the main facuet shell 21, except the lower portions of the cold water inlet pipe 132 and the hot water inlet pipe 133. Near the upper edge of the faucet throat 22 and respective to the size of the faucet head 131*a*, a faucet opening 221 is formed for the faucet head 131*a* passing therethrough; near the lower edge of the faucet throat 22 and respective to the size of the infra-red emitter/sensor 33, a sensor slot 222 is formed for permitting the infra-red emitter/sensor 33 placing and exposing thereon. A handle 24 is elongated in shape and has a rear circular portion thereon a snap-fitting hole being formed for connecting with the valve stem 141. A handle socket 23 has, being mainly provided as a connecting means, a lower opening, having a female-threaded portion on its inner surface, and a receiving hole 231 on its upper edge, being corresponding to and for defining the rear portion of the handle 24 entrance to connect the valve stem 141 with the snap-fitting hole of the handle 24.

OPERATION OF THE PRESENT INVENTION

First, place the ball valve 14 into hemispherical valve seat 113 with the holding protrusion 114 passing through the holding groove 148, then make the valve stem 141 pass through the H shaped guide groove 152 of the valve stem guide 15, resting on the valve seat rim 111 by placing its locking protrusion 154 in any one of the receiving notches 112, and then fasten the solenoid valve 31 to the solenoid valve holder 12 by connecting means. By this means, the proximity actuation assembly 30 is connected with the main assembly 10. By placing the main assembly 10 and the proximity actuation assembly 30 into the main faucet shell 21, the valve stem 141 of the ball valve 14 in the main assembly 10 will slightly protrude from the handle socket seat 213. Before connecting the faucet throat cover 22 and the faucet throat 212, first, place the outlet pipe 131 into the faucet neck 211 and ensures the faucet head 131*a* protruding through the faucet opening 221. The infra-red emitter/sensor 33 protruding through the sensor slot 222. On the lower inner surface of the handle socket 23 is formed a female-threaded portion. On the upper periphery of the valve seat body 11 is formed a male-threaded portion. Connect the handle socket 23 with the valve seat body 11 by screwing manners. Attach the valve stem 141 to the handle 24 by snap-fitting manners. Then the assembly of the present invention is completed.

Referring to FIGS. 4,5,6,7 and 12, when the handle 24 is pulled forwardly to the users, the valve stem 141 will be moved forwardly to turn the front water outlet hole 142 to match the front water outlet channel 117, the hot water inlet hole 143 and the cold water inlet hole 144 to respectively match the hot water inlet hole 115 and the cold water inlet hole 116. In this position, the improved faucet is controlled by electronic means, namely the proximity actuation assembly 30. The hot water flows into the hot water inlet pipe 133 through the connection means 133*a*; and the cold water, into the cold water inlet pipe 132 through the connection means 132*a*. Then the hot water and the cold water respectively pass through the hot water inlet hole 115 and the cold water inlet hole 116, then the front hot water inlet hole 143 and the front cold water inlet hole 144. The hot water and the cold water here mix together and come out from the front water outlet hole 142 and flow through the front water outlet channel 117 to the solenoid valve inlet 127. When the user is in front of the improved faucet, then the infra-red emitter/sensor 33 will transmit a signal to the solenoid valve 31 to open the valve inlet hole 124, and the water will pass through the bi-directional feed pipe 134; the other end of the feed pipe 134 where connects with the rear water outlet channle 118 is completely blocked up, so the water will be forced by the water pressure and flow through the pipe juncture 134*a* and the outlet pipe 131. Finally the water comes out of the faucet head 131*a*. The water temperature is adjustable by turning the handle 24 clockwise or counterclockwise. When the user leaves, the infra-red emitter/sensor will then transmit another signal to the solenoid valve 31, and the valve outlet hole 124 will be blocked up immediately. If power failure occurs, the handle 24 could be pulled backwardly to the users and the control way is changed to hand control. When the handle 24 is pulled backwardly, the rear water outlet hole 145 will match the rear water outlet channel 118, the rear hot water inlet hole 146 and the cold water inlet hole 147 match respectively the hot water inlet hole 115 and the cold water inlet hole 116. The hot water and the cold water flow into the hot water inlet pipe 133 and the cold water inlet pipe 132 through their connection means 133*a* and 132*a* seperately, then pass through the hot inlet hole 115 and the cold inlet hole 116 and flow into the rear hot water inlet hole 146 and the rear cold water inlet hole 147. The hot water and the cold water here mix together and come out from the rear water outlet hole 145 and pass through the rear water outlet channle 118 and the outlet pipe 131. At last, the water comes out of the faucet head 131*a*. Again, when the temperature of the water needs to be adjusted, just turn the handle 24 clockwise or counterclockwise. Moreover, if the improved faucet will not be used for a long while, pull the handle 24 upwardly in the middle, not forward or backward to the users, but right in the middle.

I claim:

1. a faucet that has interchangeable proximity actuation control and hand control for hot/cold water comprising:

a proximity actuation assembly attaching to a main assembly, being placed and covered by a faucet shell assembly;

said main assembly having a valve seat body, a solenoid holder, a water conduit assembly, a ball valve and a valve stem guide thereof;

said valve seat body having, a hemispherical valve seat on its inner bottom surface, thereon a hot water and a cold water inlet hole being, respectively opposed, located at the same planes as taken from top view, a front water and a rear water outlet hole, extending respectively from the middle of the plane at the opposite directions, being respectively located on said hemispherical valve seat, from thereon extending upwardly, a holding protrusion, being formed on the inner surfce of said valve seat body, said solenoid valve holder, being provided for attaching said proximity actuation assembly to said solenoid valve holder;

said water conduit assembly, comprising: a hot water inlet pipe and a cold water inlet pipe, being respectively connected with a said hot water inlet hole and said cold water inlet hole, a bi-direction feed pipe having, a pipe juncture being, formed on its concave spherical surface therewith connecting an outlet pipe at its lower end thereon extending outwardly and upwardly being formed a faucet head, provided for permitting the occurring of power failure the water pressure forcing the water passing therethrough, connecting said valve outlet hole with one end, said rear water outlet channel with the other end;

said ball valve being corresponding to the inner surface of said hemispherical valve seat and having, a valve stem, extending upwardly and outwardly from its upper periphery, a holding groove, extending axially from said valve stem, a front water outlet hole and a rear water outlet hole, being colinear and respective to each other; respective below to the either side of said front water outlet hole, being formed a front hot water inlet hole and a front cold water inlet hole, said front water outlet hole, and said fron cold inlet hole being, respective to said front water outlet channel, hot water inlet hole and cold water inlet hole, provided for defining said proximity actuation controlling the water out from said faucet head; said rear water outlet hole, said rear hot water inlet hole and said rear cold water inlet hole being, respective to said rear water outlet channel, said hot water inlet hole and said cold water inlet hole, provided for defining said hand controlling the water out from said faucet head;

said valve stem guide having, an H-shaped guide groove being formed on its upper surface, a locking protrusion being formed on its periphery;

said faucet assembly comprising a main faucet shell, a faucet throat cover and a handle thereof; said main faucet shell, including a faucet neck, extending outwardly and somewhat upwardly from thereon, the extending of said faucet neck thereunder, shaping a faucet throat, extending concavely and downwardly to the lowe edge of said main faucet shell, a faucet throat cover being, provided for covering the assembly of said main assembly and said proximity actuation assembly inside said main faucet shell, a handle being elongated in shape and having a rear circular portion thereon a snap-fitting hole being formed for connecting with said valve stem; thereby said front water outlet channel, hot water inlet hole and cold water inlet hole being respective to said front water outlet channel, hot water inlet hole and cold water inlet hole, or said rear water outlet hole, hot water inlet hole and cold water inlet hole being respective to said rear water outlet channel, hot water inlet hole and cold water inlet hole, will be adjustable by pulling said handle to rotate said valve.

2. A faucet that has interchangeable proximity actuation control and hand control for hot/cold water as claimed in claim 1 wherein said holding groove, extending axially from said valve stem, being formed on the upper hemisphere of said ball valve for permitting said holding protrusion passing through by positioning said ball valve.

3. A faucet that has interchangeable proximity actuation control and hand cotrol for hot/cold water as claimed in claim 1 wherein said H-shaped guide groove being formed on the upper surface of said valve stem for permitting said valve stem easy pasing therethrough and moving therein.

* * * * *